US007640982B2

(12) United States Patent
Schultz et al.

(10) Patent No.: US 7,640,982 B2
(45) Date of Patent: Jan. 5, 2010

(54) METHOD OF INJECTION PLANE INITIATION IN A WELL

(75) Inventors: Roger L. Schultz, Ninnekah, OK (US); Grant Hocking, London (GB); Scott Wendorf, University Park, TX (US); Travis W. Cavender, Angleton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 209 days.

(21) Appl. No.: 11/832,602

(22) Filed: Aug. 1, 2007

(65) Prior Publication Data

US 2009/0032260 A1 Feb. 5, 2009

(51) Int. Cl.
*E21B 33/138* (2006.01)
*E21B 43/26* (2006.01)
*E21B 49/00* (2006.01)

(52) U.S. Cl. ..... 166/281; 166/250.01; 166/297; 166/308.1

(58) Field of Classification Search ..... None
See application file for complete search history.

(56) References Cited

U.S. PATENT DOCUMENTS 2,642,142 A 6/1953 Clark
2,687,179 A 8/1954 Dismukes
2,862,564 A 12/1958 Bostock
2,870,843 A 1/1959 Rodgers, Jr.
3,058,730 A 10/1962 Bays
3,062,286 A 11/1962 Wyllie
3,071,481 A * 1/1963 Beach et al. ..... 106/719
3,270,816 A 9/1966 Staadt
3,280,913 A 10/1966 Smith
3,338,317 A 8/1967 Shore
3,353,599 A 11/1967 Swift
3,690,380 A 9/1972 Grable (Continued)

FOREIGN PATENT DOCUMENTS

CA 2543886 4/2006

(Continued)

OTHER PUBLICATIONS

Halliburton Retrievable Service Tools, Cobra Frac® RR4-EV Packer, (2 pgs.) undated.

(Continued)

*Primary Examiner*—George Suchfield
(74) *Attorney, Agent, or Firm*—Marlin R. Smith

(57) ABSTRACT

Initiation of injection planes in a well. A method of forming at least one generally planar inclusion in a subterranean formation includes the steps of: expanding a wellbore in the formation by injecting a material into an annulus positioned between the wellbore and a casing lining the wellbore; increasing compressive stress in the formation as a result of the expanding step; and then injecting a fluid into the formation, thereby forming the inclusion in a direction of the increased compressive stress. Another method includes the steps of: expanding a wellbore in the formation by injecting a material into an annulus positioned between the wellbore and a casing lining the wellbore; reducing stress in the formation in a tangential direction relative to the wellbore; and then injecting a fluid into the formation, thereby forming the inclusion in a direction normal to the reduced tangential stress.

48 Claims, 8 Drawing Sheets

U.S. PATENT DOCUMENTS 3,727,688 A 4/1973 Clampitt
3,779,915 A 12/1973 Kucera
3,884,303 A 5/1975 Closmann
3,948,325 A 4/1976 Winston et al.
4,005,750 A 2/1977 Shuck
4,018,293 A 4/1977 Keller
4,311,194 A 1/1982 White
4,678,037 A 7/1987 Smith
4,834,181 A 5/1989 Uhri et al.
4,977,961 A 12/1990 Avasthi
5,010,964 A 4/1991 Cornette
5,103,911 A 4/1992 Heijnen
5,111,881 A 5/1992 Soliman et al.
5,123,487 A 6/1992 Harris et al.
5,211,714 A 5/1993 Jordan et al.
5,318,123 A 6/1994 Venditto et al.
5,325,923 A 7/1994 Surjaatmadja
5,335,724 A 8/1994 Venditto et al.
5,372,195 A 12/1994 Swanson et al.
5,386,875 A 2/1995 Venditto et al.
5,394,941 A 3/1995 Venditto et al.
5,396,957 A 3/1995 Surjaatmadja
5,431,225 A 7/1995 Abass et al.
5,472,049 A 12/1995 Chaffee et al.
5,494,103 A 2/1996 Surjaatmadja et al.
5,547,023 A 8/1996 McDaniel et al.
5,564,499 A 10/1996 Willis et al.
5,667,011 A 9/1997 Gill et al.
5,743,334 A 4/1998 Nelson
5,765,642 A 6/1998 Surjaatmadja
5,829,520 A 11/1998 Johnson
5,944,446 A 8/1999 Hocking
5,981,447 A 11/1999 Chang et al.
6,003,599 A 12/1999 Huber et al.
6,116,343 A 9/2000 Van Petegem et al.
6,176,313 B1 1/2001 Coenen et al.
6,216,783 B1 4/2001 Hocking et al.
6,283,216 B1 9/2001 Ohmer
6,330,914 B1 12/2001 Hocking et al.
6,443,227 B1 9/2002 Hocking et al.
6,446,727 B1 9/2002 Zemlak et al.
6,508,307 B1 1/2003 Almaguer
6,543,538 B2 4/2003 Tolman et al.
6,662,874 B2 12/2003 Surjaatmadja et al.
6,719,054 B2 4/2004 Cheng et al.
6,722,437 B2 4/2004 Vercaemer et al.
6,725,933 B2 4/2004 Middaugh et al.
6,732,800 B2 5/2004 Acock et al.
6,779,607 B2 8/2004 Middaugh et al.
6,782,953 B2 8/2004 Maguire et al.
6,792,720 B2 9/2004 Hocking
6,991,037 B2 1/2006 Hocking
7,055,598 B2 6/2006 Ross et al.
7,059,415 B2 6/2006 Bosma et al.
7,066,284 B2 6/2006 Wylie et al.
7,069,989 B2 7/2006 Marmorshteyn
7,228,908 B2 6/2007 East, Jr. et al.
7,240,728 B2 7/2007 Cook et al.
7,278,484 B2 10/2007 Vella, et al.
7,412,331 B2 8/2008 Calhoun et al.
2002/0189818 A1 12/2002 Metcalfe
2003/0230408 A1 12/2003 Acock et al.
2004/0118574 A1 6/2004 Cook et al.
2004/0177951 A1 9/2004 Hoffman et al.
2005/0194143 A1 9/2005 Xu et al.
2005/0263284 A1 12/2005 Justus
2006/0131074 A1 6/2006 Calhoun et al.
2006/0144593 A1* 7/2006 Reddy ..... 166/292
2006/0149478 A1 7/2006 Calhoun et al.
2007/0199695 A1 8/2007 Hocking
2007/0199697 A1 8/2007 Hocking
2007/0199698 A1 8/2007 Hocking
2007/0199699 A1 8/2007 Hocking
2007/0199700 A1 8/2007 Hocking
2007/0199701 A1 8/2007 Hocking
2007/0199702 A1 8/2007 Hocking
2007/0199704 A1 8/2007 Hocking
2007/0199705 A1 8/2007 Hocking
2007/0199706 A1 8/2007 Hocking
2007/0199707 A1 8/2007 Hocking
2007/0199708 A1 8/2007 Hocking
2007/0199710 A1 8/2007 Hocking
2007/0199711 A1 8/2007 Hocking
2007/0199712 A1 8/2007 Hocking
2007/0199713 A1 8/2007 Hocking
2009/0032267 A1* 2/2009 Cavender et al. ..... 166/386

FOREIGN PATENT DOCUMENTS

EP 1131534 9/2003
WO 198100016 A1 1/1981
WO WO 0001926 1/2000
WO WO 200029716 5/2000
WO 2004092530 A2 10/2004
WO WO 2005065334 7/2005
WO WO 200700956 9/2007
WO WO 200712175 10/2007
WO WO 200712199 10/2007
WO WO 200717787 10/2007
WO WO 200717810 10/2007
WO WO 200717865 10/2007

OTHER PUBLICATIONS

U.S. Appl. No. 11/832,615 filed Aug. 1, 2007.
Halliburton Production Optimization, Cobra Frac® Service, (2 pgs.), dated Aug. 2005.
Halliburton Drawing No. D00004932, (2 pgs), dated Sep. 10, 1999.
Serata Geomechanics Corporation, "Stress/Property Measurements for Geomechanics," www.serata.com, dated 2005-2007.
ISTT, "Trenchless Pipe Replacement," (1 pg), dated Dec. 11, 2006.
ISTT, "Rerounding" (2 pgs), dated Dec. 11, 2006.
STAR Frac Completion System brochure, (4 pgs.), dated Winter/Spring 2006.
Wenlu Zhu, et al., "Shear-enhanced Compaction and Permeability Reduction: Triaxial Extension Tests on Porous Sandstone," Mechanics of Materials, (16 pgs.) dated 1997.
S.L. Karner, "What Can Granular Media Teach Us About Deformation in Geothermal Systems?" ARMA, dated 2005.
M.R. Coop, "The Mechanics of Uncemented Carbonate Sands," Geotechnique vol. 40, No. 4, (pp. 607-626), dated 1990.
M.R. Coop and J.H. Atkinson, "The Mechanics of Cemented Carbonate Sands," Geotechnique vol. 43, No. 1, (pp. 53-67), dated 1993.
T. Cuccovillo and M.R. Coop, "Yielding and Pre-failure Deformation of Structured Sands," Geotechnique vol. 47, No. 3, (pp. 491-508), dated 1997.
Lockner and Stanchits, "Undrained Pore-elastic Response of Sandstones to Deviatoric Stress Change," Porelastic Response of Sandstones, (30 pgs.) dated 2002.
Axel Kaselow and Serge Shapiro, "Stress Sensitivity of Elastic Moduli and Electrical Resistivity in Porous Rocks," Journal of Geophysics and Engineering, dated Feb. 11, 2004.
Lockner and Beeler, "Stress-Induced Anisotropic Porelasticity Response in Sandstone," dated Jul. 2003.
G.V. Rotta, et al., "Isotropic Yielding in an Artificially Cemented Soil Cured Under Stress," Geotechnique, vol. 53, No. 53, (pp. 493-501), dated 2003.
T.F. Wong and P. Baud, "Mechanical Compaction of Porous Sandstone," Oil and Gas Science and Technology, (pp. 715-727), dated 1999.
U.S. Appl. No. 11/610,819, filed Dec. 14, 2006.
U.S. Appl. No. 11/966,212, filed Dec. 28, 2007.
U.S. Appl. No. 11/832,620, filed Aug. 1, 2007.
U.S. Appl. No. 11/545,749, filed Oct. 10, 2006.
U.S. Appl. No. 11/753,314, filed May 24, 2007.

U.S. Appl. No. 11/977,772, filed Oct. 26, 2007.
Office Action issued Jan. 26, 2009, for U.S. Appl. No. 11/832,615, 23 pages.
Office Action issued Feb. 2, 2009, for Canadian Patent Application Serial No. 2,596,201, 3 pages.
Office Action issued May 15, 2009, for U.S. Appl. No. 11/010,819, 26 pages.
International Search Report and Written Opinion issued Oct. 8, 2008, for International Patent Application No. PCT/US08/070780, 8 pages.
International Search Report and Written Opinion issued Sep. 25, 2008, for International Patent Application No. PCT/US07/87291, 11 pages.
International Search Report and Written Opinion issued Oct. 22, 2008, for International Patent Application Serial No. PCT/US08/70756, 11 pages.
Office Action issued Jun. 12, 2009, for U.S. Appl. No. 11/832,620, 37 pages.
Office Action issued Sep. 24, 2009, for U.S. Appl. No. 11/966,212, 37 pages.
Office Action issued Sep. 29, 2009, for U.S. Appl. No. 11/610,819, 12 pages.

* cited by examiner

FIG. 1
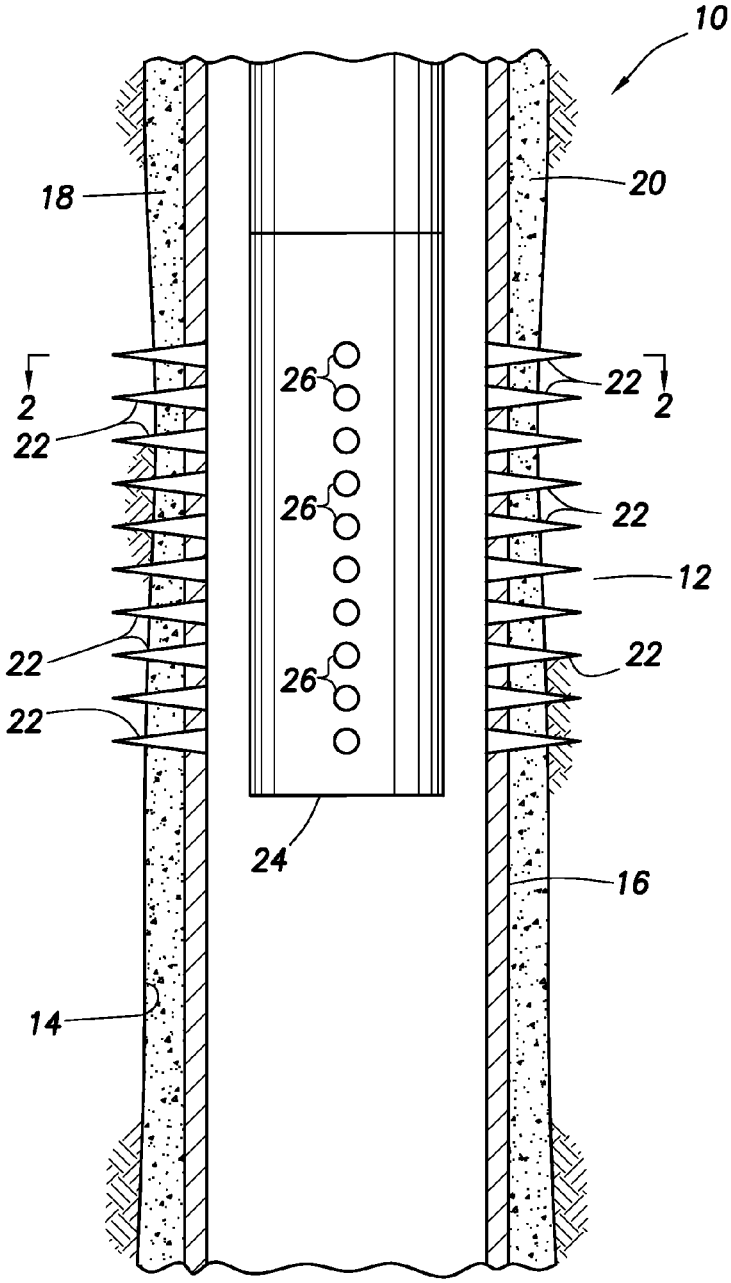
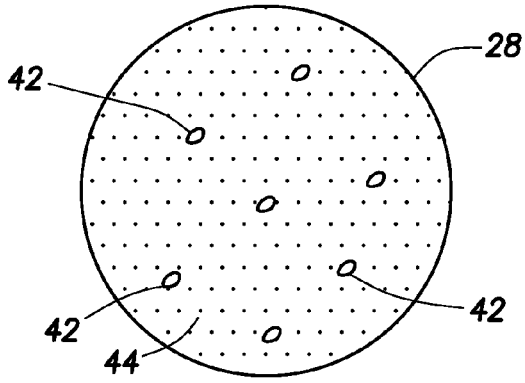
FIG. 6

FIG. 10
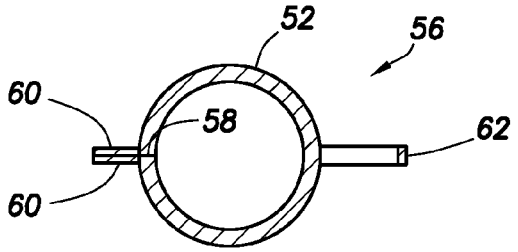
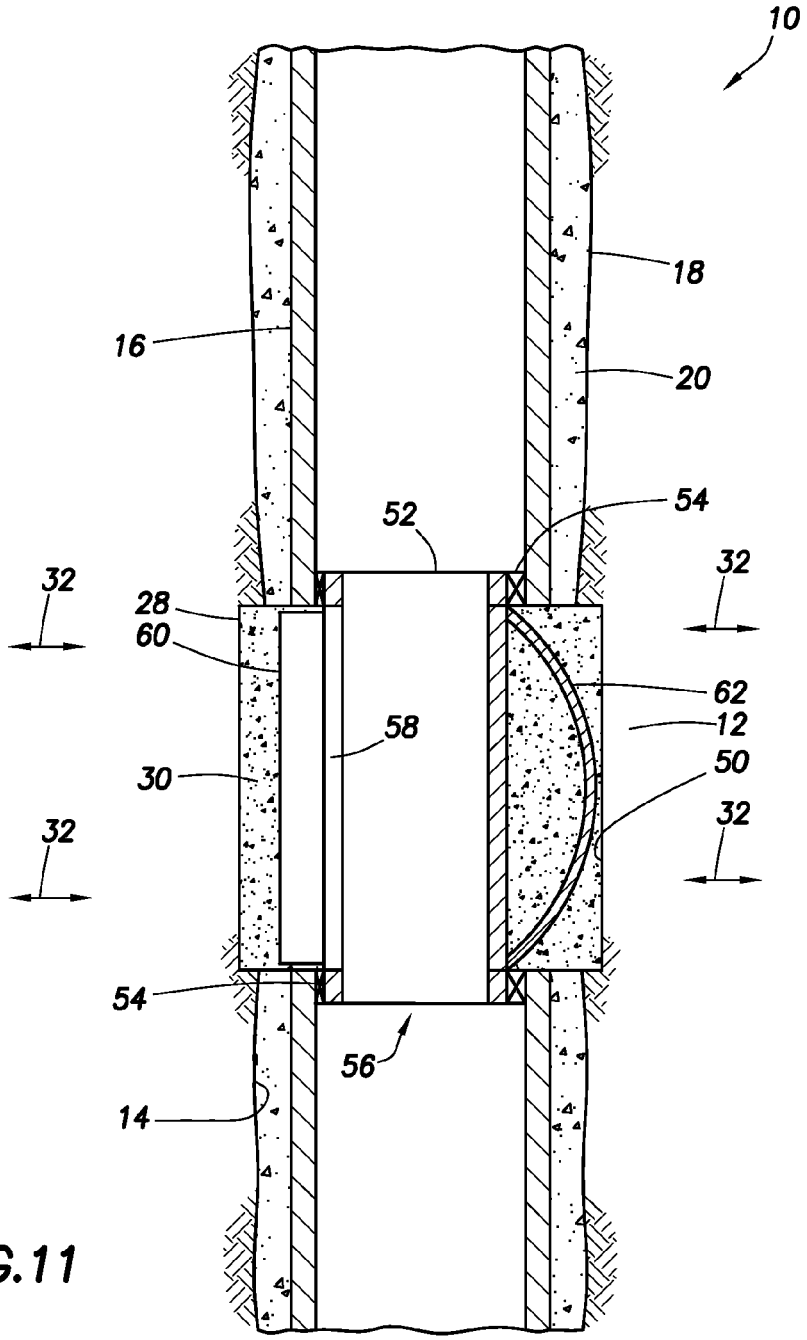
FIG. 11

METHOD OF INJECTION PLANE INITIATION IN A WELL

BACKGROUND

The present invention relates generally to equipment utilized and operations performed in conjunction with a subterranean well and, in an embodiment described herein, more particularly provides a method of initiating injection planes in a well.

It is frequently desirable to be able to form generally planar inclusions in a subterranean formation or zone, in order to enhance production or injection of fluids between one or more wellbores and the formation or zone. It is even more desirable to be able to reliably orient such planar inclusions in selected directions, to extend the inclusions for desired distances and, in many circumstances, to maintain the planar form of the inclusions.

Hydraulic fracturing comprises a variety of well known methods of forming fractures in relatively hard and brittle rock. However, many of these methods have not been entirely successful in achieving precise directional orientation, dimensional control or planar form of such fractures.

Furthermore, the advanced techniques developed for the art of forming fractures in brittle rock are often inapplicable to the fundamentally different material properties of unconsolidated and/or weakly cemented formations. The rock in such formations behaves in a manner more accurately described as "ductile," and defies attempts to orient and otherwise control planar inclusions therein.

Therefore, it may be seen that advancements are needed in the art of forming generally planar inclusions in subterranean formations. These advancements may find application in both brittle and ductile rock formations.

SUMMARY

In carrying out the principles of the present invention, methods are provided which solve at least one problem in the art. One example is described below in which an injection plane is initiated in a desired direction. Another example is described below in which the injection plane initiation facilitates directional, dimensional and geometric control over a generally planar inclusion in a formation.

In one aspect, a method of forming at least one generally planar inclusion in a subterranean formation is provided. The method includes the steps of: expanding a wellbore in the formation by injecting a material into an annulus positioned between the wellbore and a casing lining the wellbore; increasing compressive stress in the formation as a result of the expanding step; and then injecting a fluid into the formation, thereby forming the inclusion in a direction of the increased compressive stress.

In another aspect, a method of forming at least one generally planar inclusion in a subterranean formation includes the steps of: expanding a wellbore in the formation by injecting a material into an annulus positioned between the wellbore and a casing lining the wellbore; reducing stress in the formation in a tangential direction relative to the wellbore; and then injecting a fluid into the formation, thereby forming the inclusion in a direction normal to the reduced tangential stress.

In a further aspect, a method of forming at least one generally planar inclusion in a subterranean formation includes the steps of: increasing compressive stress in the formation by injecting a material into an annulus positioned between the formation and a sleeve positioned in casing lining a wellbore; and then injecting a fluid into the formation, thereby forming the inclusion in a direction of the increased compressive stress.

These and other features, advantages, benefits and objects will become apparent to one of ordinary skill in the art upon careful consideration of the detailed description of representative embodiments of the invention hereinbelow and the accompanying drawings, in which similar elements are indicated in the various figures using the same reference numbers.

BRIEF DESCRIPTION OF THE DRAWINGS

FIG. 1 is a schematic partially cross-sectional view of a system and method embodying principles of the present invention;

FIG. 6 is an enlarged scale view of a material indicated by aperture 6 of FIG. 2

FIGS. 10-12 are schematic cross-sectional views of a second alternate configuration of the system and method.

DETAILED DESCRIPTION

Figure 2:
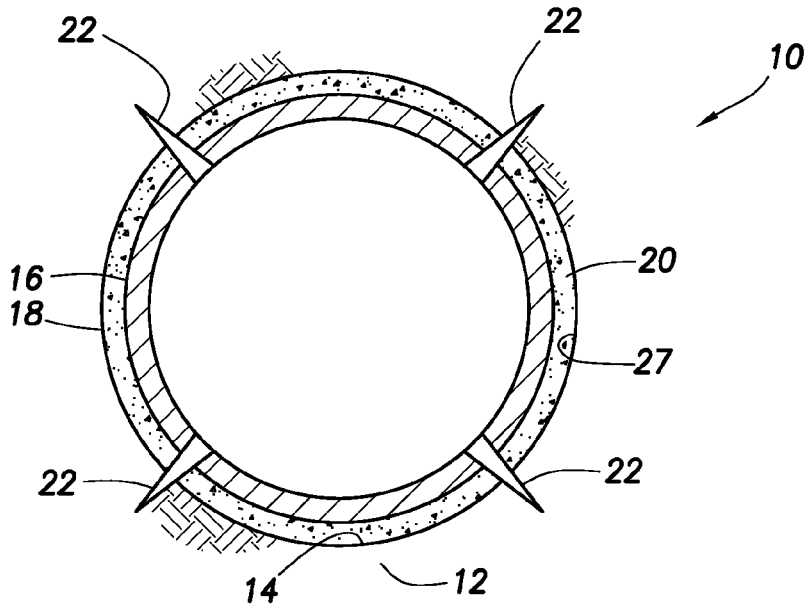
FIG. 2 is an enlarged scale schematic cross-sectional view through the system, taken along line 2-2 of FIG. 1, after initial steps of the method have been performed.

It is to be understood that the various embodiments of the present invention described herein may be utilized in various orientations, such as inclined, inverted, horizontal, vertical, etc., and in various configurations, without departing from the principles of the present invention. The embodiments are described merely as examples of useful applications of the principles of the invention, which is not limited to any specific details of these embodiments.

In the following description of the representative embodiments of the invention, directional terms, such as "above", "below", "upper", "lower", etc., are used for convenience in referring to the accompanying drawings. In general, "above", "upper", "upward" and similar terms refer to a direction toward the earth's surface along a wellbore, and "below", "lower", "downward" and similar terms refer to a direction away from the earth's surface along the wellbore.

Representatively illustrated in FIG. 1 is a system 10 and associated method for initiating the forming of one or more generally planar inclusions in a subterranean formation 12. The system 10 and method embody principles of the present invention, but it should be clearly understood that the invention is not limited to any specific features or characteristics of the system or method described below.

As depicted in FIG. 1, a wellbore 14 has been drilled into the formation 12 and has been lined with protective casing 16. As used herein, the term "casing" refers to any form of protective lining for a wellbore (such as those linings known to persons skilled in the art as "casing" or "liner", etc.), made of any material or combination of materials (such as metals, polymers or composites, etc.), installed in any manner (such as by cementing in place, expanding, etc.) and whether continuous or segmented, jointed or unjointed, threaded or otherwise joined, etc.

Cement or another sealing material 18 has been flowed into an annulus 20 between the wellbore 14 and the casing 16. The sealing material 18 is used to seal and secure the casing 16 within the wellbore 14. Preferably, the sealing material 18 is a hardenable material (such as cement, epoxy, etc.) which may be flowed into the annulus 20 and allowed to harden therein in order to seal off the annulus and secure the casing 16 in position relative to the wellbore 14. However, other types of materials (such as swellable materials conveyed into the wellbore 14 on the casing 16, etc.) may be used, without departing from the principles of the invention.

When the casing 16 is sealed and secured in the wellbore 14, perforations 22 are formed through the casing and sealing material 18. Preferably, the perforations 22 are formed using a perforating gun 24 having longitudinally aligned explosive charges 26, and the perforations are preferably formed after the casing 16 is sealed and secured in the wellbore 14. However, other methods of forming the perforations 22 may be used (such as by use of a jet cutting tool, a linear explosive charge, drill, mill, etc.), and other sequences of steps in the method may be used (such as by forming the perforations prior to installation of the casing 16 in the wellbore 14) in keeping with the principles of the invention.

A schematic cross-sectional view of the system 10 after the perforations 22 are formed is representatively illustrated in FIG. 2. In this view it may be seen that the perforations 22 preferably extend somewhat radially beyond the sealing material 18 and into the formation 12. However, it will be appreciated that, if the perforations 22 are formed through the casing 16 and/or sealing material 18 prior to installation of the casing, the perforations may not extend radially into the formation 12 at all.

Instead, an important benefit of the perforations 22 in the system 10 is that the perforations provide for fluid communication between the interior of the casing 16 and an interface 27 between the sealing material 18 and the formation 12. This fluid communication can be provided in a variety of configurations and by a variety of techniques, without necessarily forming the perforations 22 in any particular manner, at any particular time, in any particular arrangement or configuration, etc.

Figure 3:
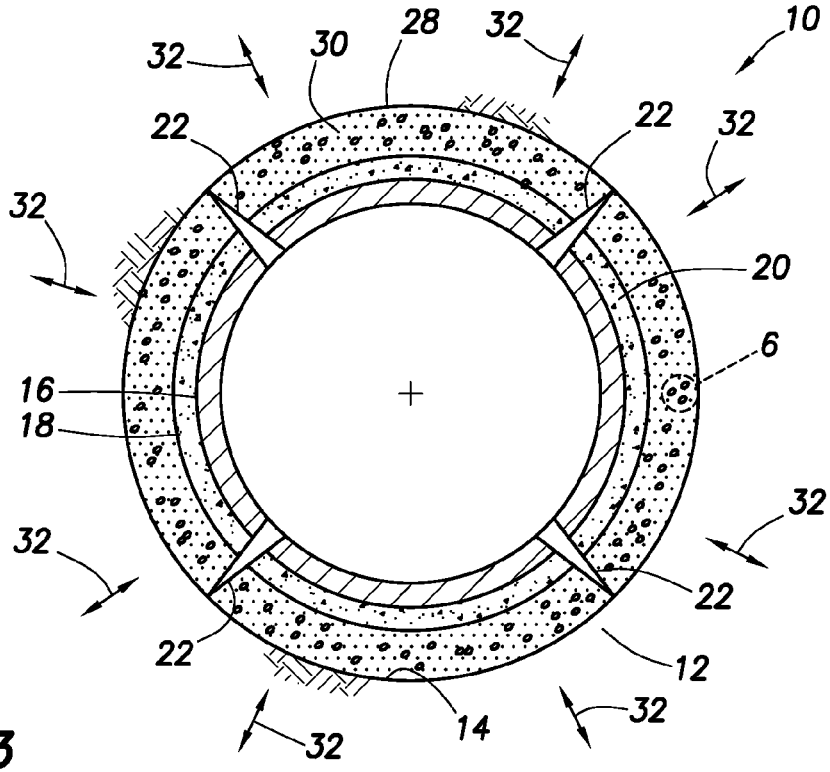
FIG. 3 is a schematic cross-sectional view through the system, after additional steps of the method have been performed.

Referring additionally now to FIG. 3, the system 10 is representatively illustrated after a hardenable material 28 has been injected between the formation 12 and the sealing material 18, thereby forming another annulus 30 radially outwardly adjacent the annulus 20. Preferably, the hardenable material 28 is flowed from the interior of the casing 16 to the interface 27 between the sealing material 18 and the formation 12 via the perforations 22, but other techniques for injecting the hardenable material and forming the annulus 30 may be used, if desired.

It will be appreciated that forming the annulus 30 causes the formation 12 to be radially outwardly displaced, and thereby radially compressed about the wellbore 14. Specifically, compressive stress along radii of the wellbore 14 (indicated in FIG. 3 by double-headed arrows 32) is increased in the formation 12 surrounding the wellbore as a radial thickness of the annulus 30 increases.

The hardenable material 28 is preferably injected into the annulus 30 under sufficient pressure to form the annulus between the sealing material 18 and the formation 12, and thereby substantially increase the radial compressive stress 32 in the formation 12 about the wellbore 14. Note that the wellbore 14 itself expands radially outward as a radial thickness of the annulus 30 increases.

The hardenable material 28 is preferably a material which hardens and becomes more rigid after being flowed into the annulus 30. Cementitious material, polymers (e.g., epoxies, etc.) and other types of materials may be used for the hardenable material 28. The hardenable material 28 could be cement, resin coated sand or proppant, or epoxy coated sand or proppant (such as EXPEDITE™ proppant available from Halliburton Energy Services of Houston, Tex.). When the material 28 hardens and becomes more rigid, it is thereby able to radially outwardly support the enlarged wellbore 14 to maintain the increased compressive stresses 32 in the formation 12.

If the well is an existing producer/injector well, then there may be preexisting perforations formerly used to flow fluids between the formation 12 and the interior of the casing 16. In that case, it may be advantageous to squeeze a sealing material into the preexisting perforations prior to forming the perforations 22.

In this manner, the perforations 22 can be configured, oriented, phased, etc., as desired for subsequent injection of the hardenable material 28 through the perforations 22. For example, a sealing material could be injected into the preexisting perforations to seal them off, and then the perforations 22 could be formed to allow injection of the hardenable material 28 into the annulus 30.

Another alternative would be to use the preexisting perforations for the perforations 22. That is, the hardenable material 28 could be injected into the annulus 30 via the preexisting perforations (which would thus serve as the perforations 22 depicted in FIGS. 1-3), thereby eliminating at least one perforating step in the method.

Figure 4:
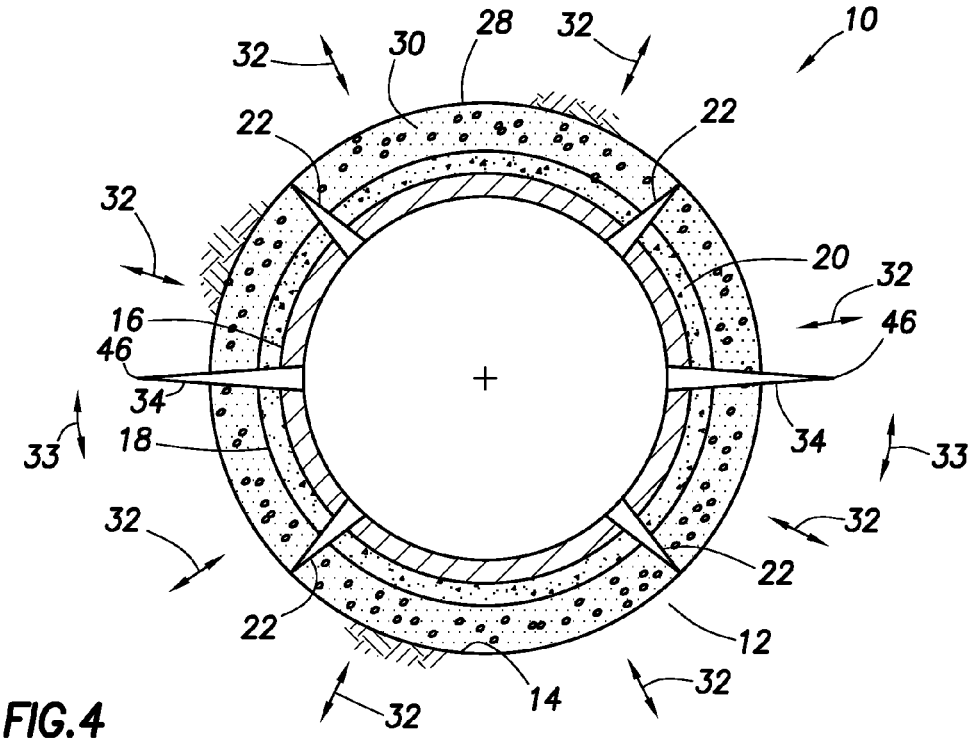
FIG. 4 is a schematic cross-sectional view through the system, after further steps of the method have been performed.

Referring additionally now to FIG. 4, the system 10 is representatively illustrated after additional perforations 34 have been formed between the interior of the casing 16 and the formation 12 about the wellbore 14. The perforations 34 extend through the casing 16, annulus 20 and annulus 30 to thereby provide fluid communication between the interior of the casing and the formation 12.

The perforations 34 may be formed using any of the methods described above for forming the perforations 22 (e.g., perforating gun, jet cutting tool, drill, linear shaped charge, etc.). Other methods may be used, if desired. If the perforating gun 24 is used, then preferably the explosive charges 26 are longitudinally aligned in the perforating gun as illustrated in FIG. 1.

As depicted in FIG. 4, there are two sets of the perforations 34, with the sets of perforations being oriented 180 degrees from each other. However, there could be any number of sets of perforations 34 (including only a single set of perforations), with any number of perforations in each set, and the sets of perforations could be at any angular orientation with respect to each other.

It may be advantageous to form only a single set of the perforations 34 (e.g., using a so-called "zero phase" perforating gun). However, in existing gas wells, the inventors postulate that it would be preferable to form four sets of the perforations 34 (i.e., 90 degree phased), and to subsequently form orthogonally oriented planar inclusions in the formation 12 (i.e., four inclusions formed in two orthogonal planes.

It will be appreciated that, after the perforations 34 are formed, the stresses 33 in the formation 12 tangential to the wellbore 14 are relieved up to the tips 46 of the perforations. Since the sets of perforations 34 are longitudinally aligned along the wellbore 14, this creates a longitudinally extending region of reduced tangential stress in the formation 12 corresponding to each set of perforations. This stress state is desirable for orienting and initiating planar inclusions in the formation 12, because the inclusions will tend to form as planes normal to the reduced tangential stress 33 at each set of perforations 34.

Figure 5:
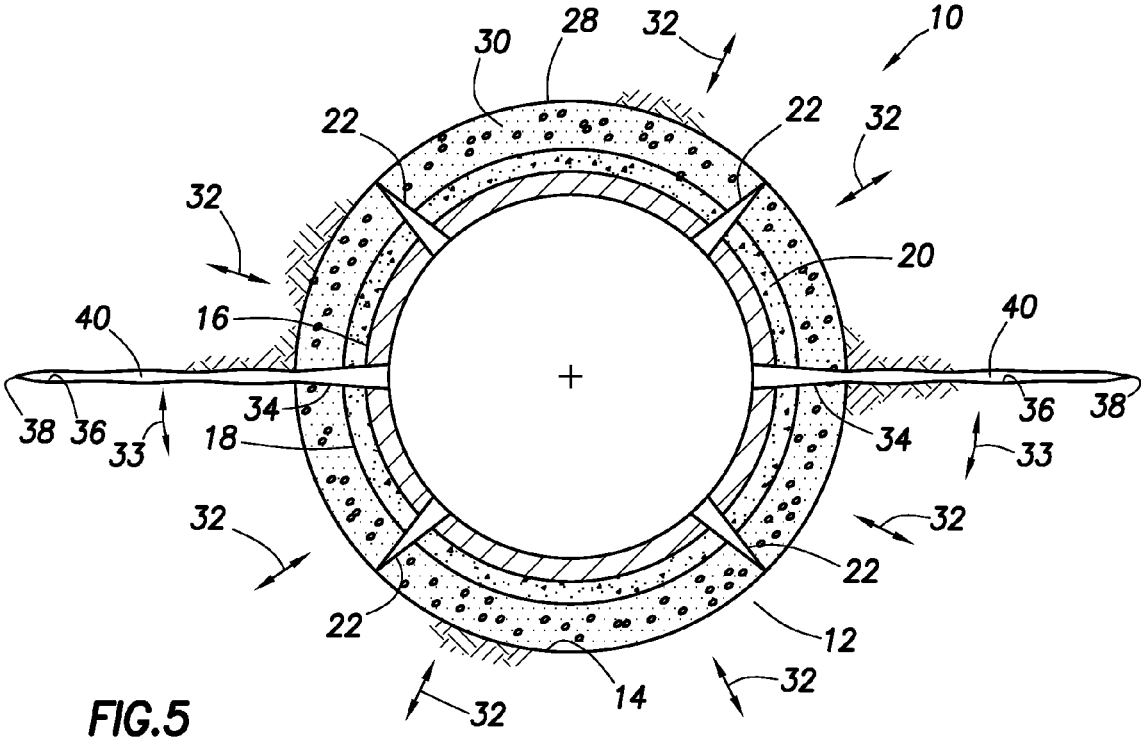
FIG. 5 is a schematic cross-sectional view through the system, after still further steps of the method have been performed.

Referring additionally now to FIG. 5, the system 10 is representatively illustrated after generally planar inclusions 36 have been formed in the formation 12 extending radially outward from the perforations 34. The planar inclusions 36 are preferably formed by injecting fluid 40 from the interior of the casing 16 and into the formation 12 via the perforations 34.

The increased radial compressive stresses 32 in the formation 12 assist in directionally controlling the forming of the inclusions 36, since it is known that formation rock will generally part in a direction perpendicular to the minimum principal stress direction. By intentionally increasing the stresses 32 in a radial direction relative to the wellbore 14, the minimum principal stress direction in the formation 12 about the wellbore is tangential to the wellbore, and thus the formation will at least initially dilate in the radial direction.

The inclusions 36 could be formed simultaneously, or they could be formed individually (one at a time), or they could be formed in any sequence or combination. Any number, orientation and combination of inclusions 36 may be formed in keeping with the principles of the present invention. As discussed above, one alternative is to form four inclusions 36 along two orthogonal planes (e.g., using four sets of the perforations 34), which configuration may be especially preferable for use in existing gas wells. In that case, it may also be preferable to simultaneously inject the fluid 40 through all four sets of the perforations 34 to thereby form the four inclusions 36 simultaneously.

The formation 12 could be comprised of relatively hard and brittle rock, but the system 10 and method find especially beneficial application in ductile rock formations made up of unconsolidated or weakly cemented sediments, in which it is typically very difficult to obtain directional or geometric control over inclusions as they are being formed.

Weakly cemented sediments are primarily frictional materials since they have minimal cohesive strength. An uncemented sand having no inherent cohesive strength (i.e., no cement bonding holding the sand grains together) cannot contain a stable crack within its structure and cannot undergo brittle fracture. Such materials are categorized as frictional materials which fail under shear stress, whereas brittle cohesive materials, such as strong rocks, fail under normal stress.

The term "cohesion" is used in the art to describe the strength of a material at zero effective mean stress. Weakly cemented materials may appear to have some apparent cohesion due to suction or negative pore pressures created by capillary attraction in fine grained sediment, with the sediment being only partially saturated. These suction pressures hold the grains together at low effective stresses and, thus, are often called apparent cohesion.

The suction pressures are not true bonding of the sediment's grains, since the suction pressures would dissipate due to complete saturation of the sediment. Apparent cohesion is generally such a small component of strength that it cannot be effectively measured for strong rocks, and only becomes apparent when testing very weakly cemented sediments.

Geological strong materials, such as relatively strong rock, behave as brittle materials at normal petroleum reservoir depths, but at great depth (i.e. at very high confining stress) or at highly elevated temperatures, these rocks can behave like ductile frictional materials. Unconsolidated sands and weakly cemented formations behave as ductile frictional materials from shallow to deep depths, and the behavior of such materials are fundamentally different from rocks that exhibit brittle fracture behavior. Ductile frictional materials fail under shear stress and consume energy due to frictional sliding, rotation and displacement.

Conventional hydraulic dilation of weakly cemented sediments is conducted extensively on petroleum reservoirs as a means of sand control. The procedure is commonly referred to as "Frac-and-Pack." In a typical operation, the casing is perforated over the formation interval intended to be fractured and the formation is injected with a treatment fluid of low gel loading without proppant, in order to form the desired two winged structure of a fracture. Then, the proppant loading in the treatment fluid is increased substantially to yield tip screen-out of the fracture. In this manner, the fracture tip does not extend further, and the fracture and perforations are backfilled with proppant.

The process assumes a two winged fracture is formed as in conventional brittle hydraulic fracturing. However, such a process has not been duplicated in the laboratory or in shallow field trials. In laboratory experiments and shallow field trials what has been observed is chaotic geometries of the injected fluid, with many cases evidencing cavity expansion growth of the treatment fluid around the well and with deformation or compaction of the host formation.

Weakly cemented sediments behave like a ductile frictional material in yield due to the predominantly frictional behavior and the low cohesion between the grains of the sediment. Such materials do not "fracture" and, therefore, there is no inherent fracturing process in these materials as compared to conventional hydraulic fracturing of strong brittle rocks.

Linear elastic fracture mechanics is not generally applicable to the behavior of weakly cemented sediments. The knowledge base of propagating viscous planar inclusions in weakly cemented sediments is primarily from recent experience over the past ten years and much is still not known regarding the process of viscous fluid propagation in these sediments.

However, the present disclosure provides information to enable those skilled in the art of hydraulic fracturing, soil and rock mechanics to practice a method and system 10 to initiate and control the propagation of a viscous fluid in weakly cemented sediments. The viscous fluid propagation process in these sediments involves the unloading of the formation in the vicinity of the tip 38 of the propagating viscous fluid 40, causing dilation of the formation 12, which generates pore pressure gradients toward this dilating zone. As the formation 12 dilates at the tips 38 of the advancing viscous fluid 40, the pore pressure decreases dramatically at the tips, resulting in increased pore pressure gradients surrounding the tips.

The pore pressure gradients at the tips 38 of the inclusions 36 result in the liquefaction, cavitation (degassing) or fluidization of the formation 12 immediately surrounding the tips. That is, the formation 12 in the dilating zone about the tips 38 acts like a fluid since its strength, fabric and in situ stresses have been destroyed by the fluidizing process, and this fluidized zone in the formation immediately ahead of the viscous fluid 40 propagating tip 38 is a planar path of least resistance for the viscous fluid to propagate further. In at least this manner, the system 10 and associated method provide for directional and geometric control over the advancing inclusions 36.

The behavioral characteristics of the viscous fluid 40 are preferably controlled to ensure the propagating viscous fluid does not overrun the fluidized zone and lead to a loss of control of the propagating process. Thus, the viscosity of the fluid 40 and the volumetric rate of injection of the fluid should be controlled to ensure that the conditions described above persist while the inclusions 36 are being propagated through the formation 12.

For example, the viscosity of the fluid 40 is preferably greater than approximately 100 centipoise. However, if foamed fluid 40 is used in the system 10 and method, a greater range of viscosity and injection rate may be permitted while still maintaining directional and geometric control over the inclusions 36.

The system 10 and associated method are applicable to formations of weakly cemented sediments with low cohesive strength compared to the vertical overburden stress prevailing at the depth of interest. Low cohesive strength is defined herein as no greater than 400 pounds per square inch (psi) plus 0.4 times the mean effective stress (p') at the depth of propagation.

$$c<400\text{ psi}+0.4p' \quad (1)$$

where c is cohesive strength and p' is mean effective stress in the formation 12.

Examples of such weakly cemented sediments are sand and sandstone formations, mudstones, shales, and siltstones, all of which have inherent low cohesive strength. Critical state soil mechanics assists in defining when a material is behaving as a cohesive material capable of brittle fracture or when it behaves predominantly as a ductile frictional material.

Weakly cemented sediments are also characterized as having a soft skeleton structure at low effective mean stress due to the lack of cohesive bonding between the grains. On the other hand, hard strong stiff rocks will not substantially decrease in volume under an increment of load due to an increase in mean stress.

In the art of poroelasticity, the Skempton B parameter is a measure of a sediment's characteristic stiffness compared to the fluid contained within the sediment's pores. The Skempton B parameter is a measure of the rise in pore pressure in the material for an incremental rise in mean stress under undrained conditions.

In stiff rocks, the rock skeleton takes on the increment of mean stress and thus the pore pressure does not rise, i.e., corresponding to a Skempton B parameter value of at or about 0. But in a soft soil, the soil skeleton deforms easily under the increment of mean stress and, thus, the increment of mean stress is supported by the pore fluid under undrained conditions (corresponding to a Skempton B parameter of at or about 1).

The following equations illustrate the relationships between these parameters:

$$\Delta u=B\Delta p \quad (2)$$

$$B=(K_u-K)/(\alpha K_u) \quad (3)$$

$$\alpha=1-(K/K_s) \quad (4)$$

where $\Delta u$ is the increment of pore pressure, B the Skempton B parameter, $\Delta p$ the increment of mean stress, $K_u$ is the undrained formation bulk modulus, K the drained formation bulk modulus, $\alpha$ is the Biot-Willis poroelastic parameter, and $K_s$ is the bulk modulus of the formation grains. In the system 10 and associated method, the bulk modulus K of the formation 12 is preferably less than approximately 750,000 psi.

For use of the system 10 and method in weakly cemented sediments, preferably the Skempton B parameter is as follows:

$$B>0.95\exp(-0.04p')+0.008p' \quad (5)$$

The system 10 and associated method are applicable to formations of weakly cemented sediments (such as tight gas sands, mudstones and shales) where large entensive propped vertical permeable drainage planes are desired to intersect thin sand lenses and provide drainage paths for greater gas production from the formations. In weakly cemented formations containing heavy oil (viscosity>100 centipoise) or bitumen (extremely high viscosity>100,000 centipoise), generally known as oil sands, propped vertical permeable drainage planes provide drainage paths for cold production from these formations, and access for steam, solvents, oils, and heat to increase the mobility of the petroleum hydrocarbons and thus aid in the extraction of the hydrocarbons from the formation. In highly permeable weak sand formations, permeable drainage planes of large lateral length result in lower drawdown of the pressure in the reservoir, which reduces the fluid gradients acting toward the wellbore, resulting in less drag on fines in the formation, resulting in reduced flow of formation fines into the wellbore.

Although the present invention contemplates the formation of permeable drainage paths which generally extend laterally away from a vertical or near vertical wellbore 14 penetrating an earth formation 12 and generally in a vertical plane in opposite directions from the wellbore, those skilled in the art will recognize that the invention may be carried out in earth formations wherein the permeable drainage paths and the wellbores can extend in directions other than vertical, such as in inclined or horizontal directions. Furthermore, it is not necessary for the planar inclusions 36 to be used for drainage, since in some circumstances it may be desirable to use the planar inclusions for injecting fluids into the formation 12, for forming an impermeable barrier in the formation, etc.

Referring additionally now to FIG. 6, an enlarged cross-sectional view of the hardenable material 28 injected into the annulus 30 as depicted in FIG. 3 is representatively illustrated. In this view it may be seen that the material 28 can include a mixture or combination of materials which operate to enhance the effect of increasing the radial compressive stresses 32 in the formation 12.

Specifically, the hardenable material 28 of FIG. 6 includes particles or granules of swellable material 42 in an overall hardenable material matrix 44. The swellable material 42 may be of the type which swells (increases in volume) when contacted by a particular fluid.

Swellable materials are known which swell in the presence of oil, water or gas. Some appropriate swellable materials are described in U.S. Pat. Nos. 3,385,367 and 7,059,415, and in U.S. Published Application No. 2004-0020662, the entire disclosures of which are incorporated herein by this reference.

The swellable material may have a considerable portion of cavities which are compressed or collapsed at the surface condition. Then, when being placed in the well at a higher pressure, the material is expanded by the cavities filling with fluid.

This type of apparatus and method might be used where it is desired to expand the material in the presence of gas rather than oil or water. A suitable swellable material is described in International Application No. PCT/NO2005/000170 (published as WO 2005/116394), the entire disclosure of which is incorporated herein by this reference.

Any type of swellable material, any fluid for initiating swelling of the material, and any technique for causing swelling of the swellable material, may be used in the system 10 and associated method.

Preferably, the material 42 swells after it is injected into the annulus 30, but the material could also swell prior to and during the injection operation. This swelling of the material 42 in the annulus 30 operates to increase the radial compressive stresses 32 in the formation 12 surrounding the wellbore 14 by causing radial outward expansion of the wellbore.

The matrix 44 preferably becomes substantially rigid after the material 42 has completely (or at least substantially completely) swollen to its greatest extent. In this manner, the volumetric increase provided by the material 42 in the annulus 30 is "captured" therein to maintain the increased compressive stresses 32 in the formation 12 while further steps in the method are performed.

The system 10 and associated methods described above may be used for new or preexisting wells. For example, a preexisting well could have the casing 16 and sealing material 18 already installed in the wellbore 14. When desired, the perforations 22 could be formed to inject the hardenable material 28, and then the perforations 34 could be formed to inject the fluid 40 and propagate the inclusions 36.

Figure 7:
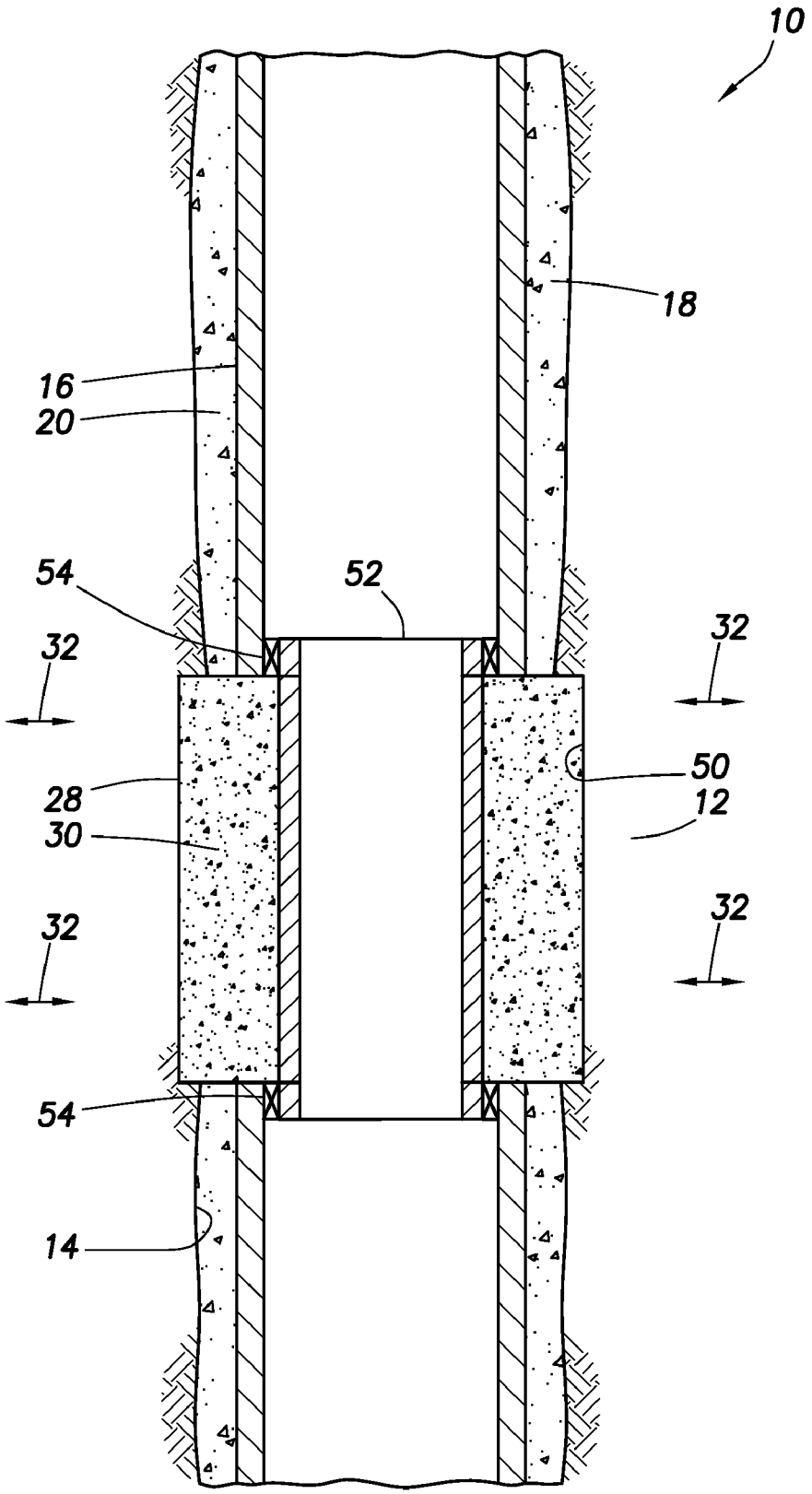
FIGS. 7-9 are schematic partially cross-sectional views of a first alternate configuration of the system and method.
Figure 8:
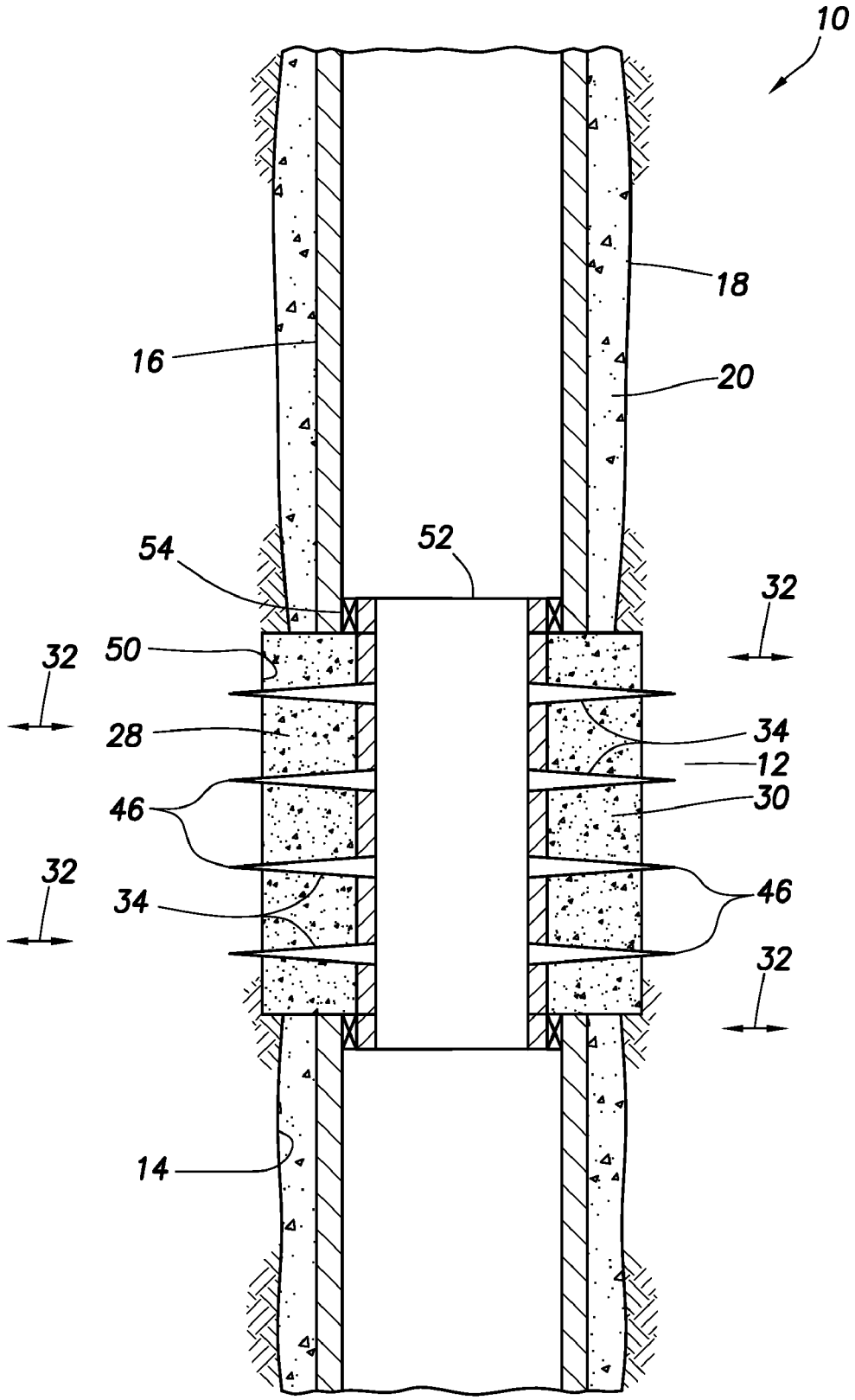
Figure 9:
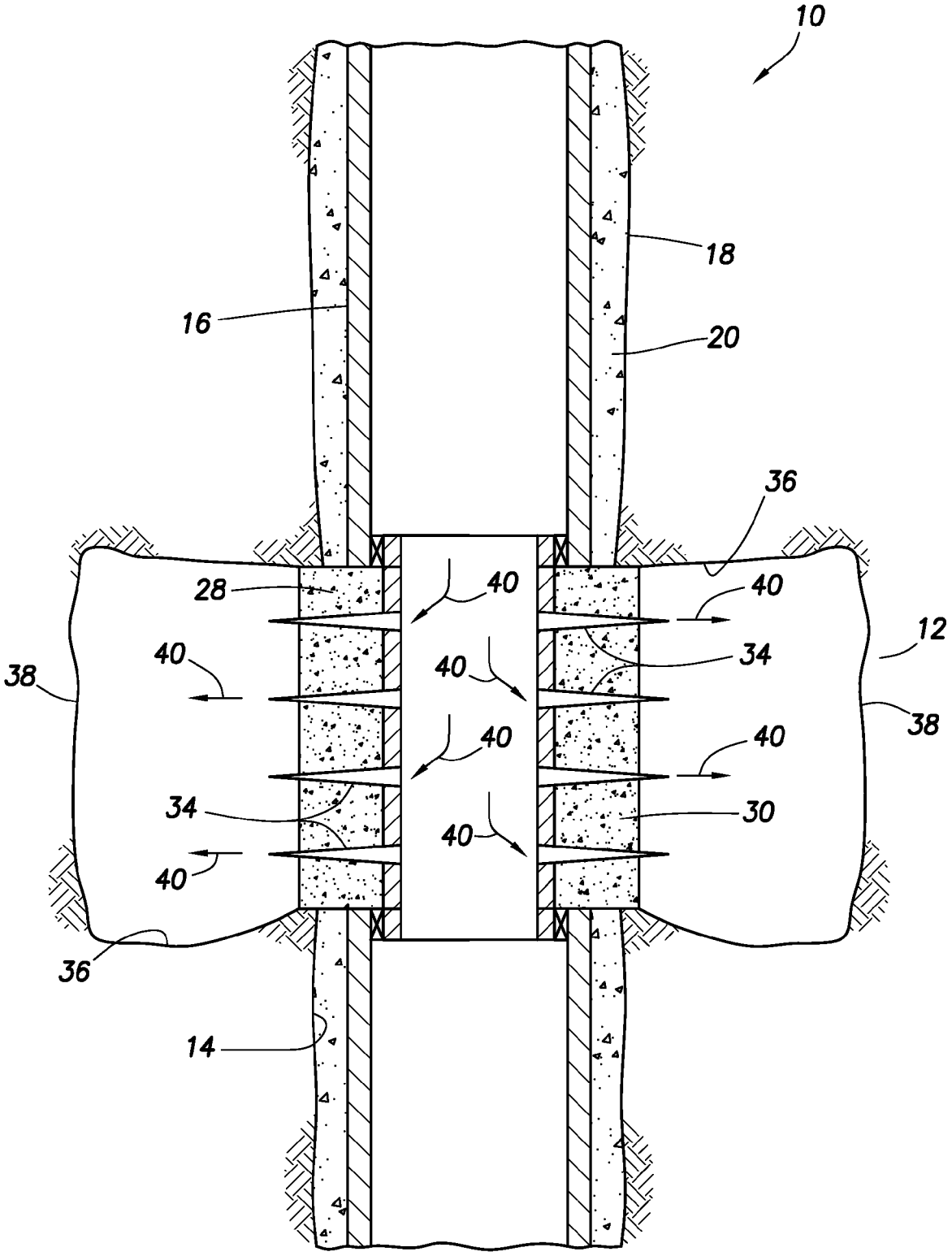

Referring additionally now to FIGS. 7-9, an alternate construction of the system 10 and method is representatively illustrated. This alternate construction is particularly useful for preexisting wells, but could be used in new wells, if desired.

As depicted in FIG. 7, instead of perforating the casing 16 and sealing material 18, a radially enlarged cavity 50 is formed through the casing, sealing material, and into the formation 12. The cavity 50 could be formed by underreaming or any other suitable technique.

A sleeve 52 is then positioned in the casing 16 straddling the cavity 50. Seals 54 (such as cup packers, expanding metal to metal seals, etc.) at each end of the sleeve 52 provide pressure isolation.

The hardenable material 28 is then injected into the cavity 50 external to the sleeve 52. For this purpose, the sleeve 52 may be equipped with ports, valves, etc. to permit flowing the material 28 from the interior of the casing 16 into the cavity 50, and then retaining the material in the cavity while it hardens and/or swells (as described above). In this manner, the increased radial compressive stresses 32 are imparted to the formation 12 surrounding the cavity 50.

In FIG. 8, the system 10 and method are depicted after the perforations 34 have been formed through the sleeve 52, annulus 30 and into the formation 12. Note that, in this alternate configuration, the perforations 34 do not extend through the sealing material 18 in the annulus 20, since the annulus 30 is not positioned exterior to the annulus 20 (as in the configuration of FIG. 4 described above). The perforations 34 may be formed using the perforating gun 24 or any of the other methods described above (e.g., jet cutting, drilling, linear explosive charge, etc.).

In FIG. 9, the system 10 and method are depicted while the fluid 40 is being pumped through the perforations 34 and into the formation 12 to thereby propagate the inclusions 36 into the formation. This step is essentially the same as described above in relation to the configuration of FIG. 5.

Figure 12:
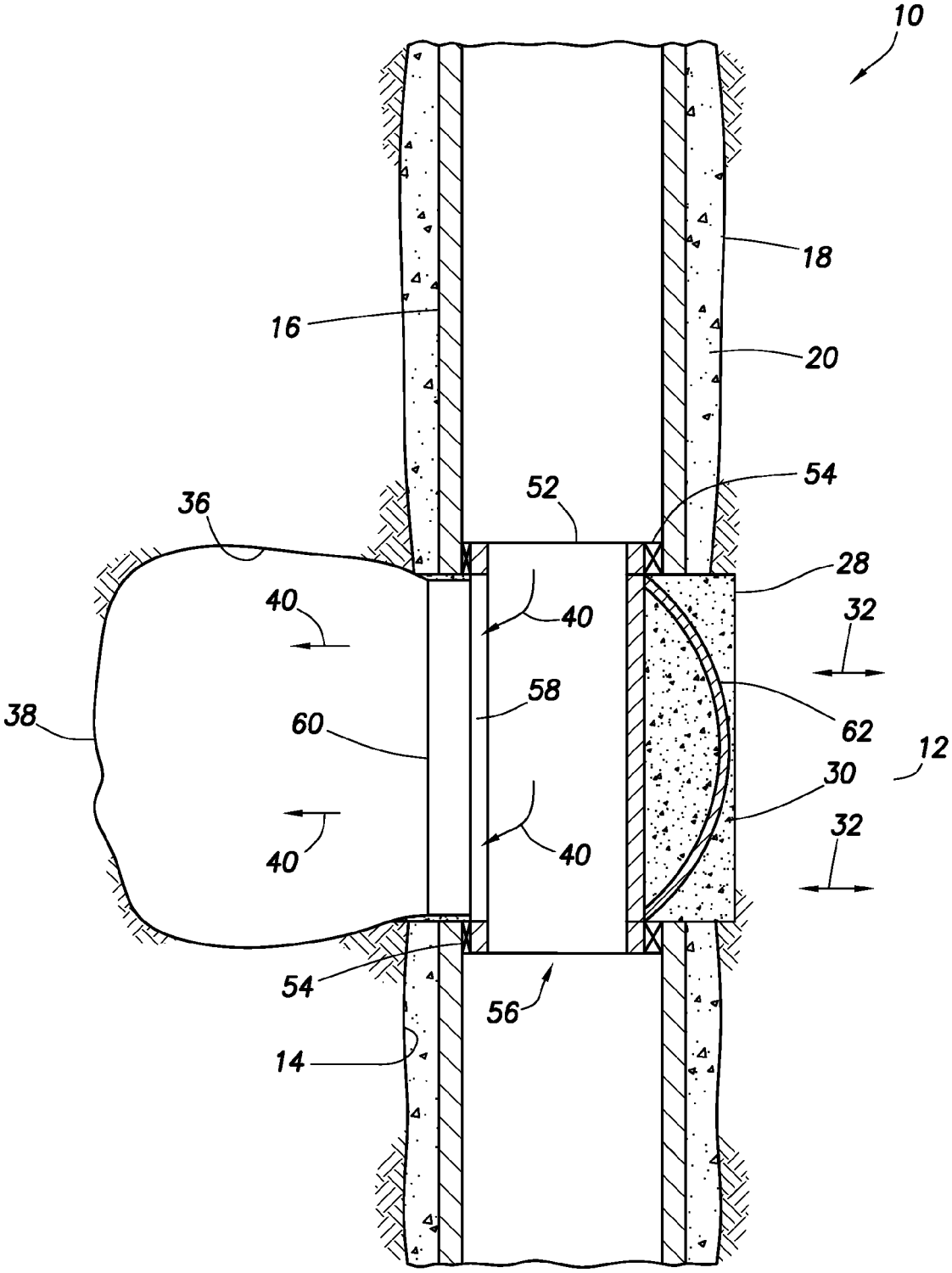

Referring additionally now to FIGS. 10-12, another alternate configuration of the system 10 and associated method is representatively illustrated. This configuration is similar in many respects to the configuration of FIGS. 7-9, in that the radially enlarged cavity 50 is formed through the casing 16 and sealing material 18.

However, the configuration of FIGS. 10-12 uses a specially constructed expandable sleeve assembly 56, instead of the perforations 34, to initiate formation of the inclusions 36. A cross-sectional view of the sleeve assembly 56 is depicted in FIG. 10. In this view, it may be seen that the sleeve 52 in this configuration is parted at a split 58, and extensions 60 extend radially outward on either side of the split.

Other configurations of the sleeve 52 and extensions 60 may be used in keeping with the principles of the invention. Some suitable configurations are described in U.S. Pat. Nos. 6,991,037, 6,792,720, 6,216,783, 6,330,914, 6,443,227, 6,543,538, and in U.S. patent application Ser. No. 11/610,819, filed Dec. 14, 2006. The entire disclosures of these patents and patent application are incorporated herein by this reference.

A bow spring-type decentralizer 62 may be used to bias the extensions 60 into the cavity 50. In FIG. 11, the sleeve assembly 56 is shown installed in the casing 16 after the cavity 50 has been formed. Note that the decentralizer 62 functions to displace the extensions 60 outward into the cavity 50.

The hardenable material 28 is then injected into the cavity 50 as described above. The increased radial compressive stresses 32 are thereby imparted to the formation 12.

In FIG. 12, the system 10 is shown as the fluid 40 is being pumped through the split 58, between the extensions 60 and into the formation 12 to propagate an inclusion 36 radially outward into the formation. The sleeve 52 may be expanded radially outward prior to and/or during the pumping of the fluid 40 in order to enlarge the split 58 and/or further increase the radial compressive stresses 32 in the formation 12, as described in the patents and patent application incorporated above.

Note that, in the configuration of FIGS. 10-12, there is no need to use the perforations 34 to initiate propagation of the inclusion 36. Instead, the expandable sleeve 52 with the extensions 60 extending radially outward provide a means for unloading the tangential stress 33 in the formation 12 prior to and/or during pumping of the fluid 40 to initiate the inclusion 36. Furthermore, although only one inclusion 36 is depicted in FIG. 12, any number of inclusions may be propagated into the formation 12 in keeping with the principles of the invention.

The system 10 and associated methods may be used for producing gas, oil or heavy oil wells, for cyclical steam injection, for water injection wells, for water source wells, for disposal wells, for coal bed methane wells, for geothermal wells, or for any other type of well. The well may be preexisting (e.g., used for hydrocarbon production operations, including production and/or injection of fluids between the wellbore and the formation) prior to performing the methods described above.

The method may be performed multiple times in a single well, and at different locations in the well. For example, a first set of one or more inclusions 36 may be formed at one location along the wellbore 14, and then another set of one or more inclusions may be formed at another location along the wellbore, etc. For the configurations of FIGS. 7-12, it may be advantageous to first form the inclusions 36 at the lowermost position in the wellbore 14, and then to form any further inclusions at progressively shallower locations.

It may now be fully appreciated that the above detailed description provides the system 10 and associated methods for forming at least one generally planar inclusion 36 in a subterranean formation 12. The method may include the steps of: expanding a wellbore 14 in the formation 12 by injecting a material 28 into an annulus 30 positioned between the wellbore and a casing 16 lining the wellbore; increasing compressive stress 32 in the formation 12 as a result of the expanding step; and then injecting a fluid 40 into the formation 12, thereby forming the inclusion 36 in a direction of the increased compressive stress 32.

The direction of the increased compressive stress 32 may be a radial direction relative to the wellbore 14. The method may further include the step of reducing stress 33 in the formation 12 in a tangential direction relative to the wellbore 14. The reducing stress step may include forming at least one perforation 34 extending into the formation 12.

The material 28 in the expanding step may be a hardenable material. The hardenable material 28 may include a swellable material 42 therein.

The annulus 30 in the expanding step may be positioned between the wellbore 14 and a sealing material 18 surrounding the casing 16.

The formation 12 may comprise weakly cemented sediment. The formation 12 may have a bulk modulus of less than approximately 750,000 psi.

The fluid injecting step may include reducing a pore pressure in the formation 12 at a tip 38 of the inclusion 36. The fluid injecting step may include increasing a pore pressure gradient in the formation 12 at a tip 38 of the inclusion 36. The fluid injecting step may include fluidizing the formation 12 at a tip 38 of the inclusion 36.

A viscosity of the fluid 40 in the fluid injecting step may be greater than approximately 100 centipoise.

The formation 12 may have a cohesive strength of less than 400 pounds per square inch plus 0.4 times a mean effective stress (p') in the formation at a depth of the inclusion 36. The formation 12 may have a Skempton B parameter greater than $0.95\exp(-0.04\,p')+0.008\,p'$, where p' is a mean effective stress at a depth of the inclusion 36.

The fluid injecting step may include simultaneously forming multiple inclusions 36 in the formation 12. The fluid injecting step may include forming four inclusions 36 approximately aligned with orthogonal planes in the formation 12.

The wellbore may have been used for at least one of production from and injection into the formation 12 for hydrocarbon production operations prior to the expanding step. For example, the well could be a preexisting gas well, or could have been used to produce hydrocarbons or inject fluids in enhanced recovery operations, prior to use of the system 10 and method described above.

The foregoing detailed description also provides a method of forming at least one generally planar inclusion 36 in a subterranean formation 12, with the method including the steps of: expanding a wellbore 14 in the formation by injecting a material 28 into an annulus 30 positioned between the wellbore and a casing 16 lining the wellbore; reducing stress 33 in the formation 12 in a tangential direction relative to the wellbore 14; and then injecting a fluid 40 into the formation 12, thereby forming the inclusion 36 in a direction normal to the reduced tangential stress 33.

The foregoing detailed description further provides method of forming at least one generally planar inclusion 36 in a subterranean formation 12, with the method including the steps of: increasing compressive stress 32 in the formation 12 by injecting a material 28 into an annulus 30 positioned between the formation and a sleeve 52 positioned in casing 16 lining a wellbore 14; and then injecting a fluid 40 into the formation 12, thereby forming the inclusion 36 in a direction of the increased compressive stress 32.

Of course, a person skilled in the art would, upon a careful consideration of the above description of representative embodiments of the invention, readily appreciate that many modifications, additions, substitutions, deletions, and other changes may be made to these specific embodiments, and such changes are within the scope of the principles of the present invention. Accordingly, the foregoing detailed description is to be clearly understood as being given by way of illustration and example only, the spirit and scope of the present invention being limited solely by the appended claims and their equivalents.

What is claimed is:

1. A method of forming at least one generally planar inclusion in a subterranean formation, the method comprising the steps of:

expanding a wellbore in the formation by injecting a material into an annulus positioned between the wellbore and a casing lining the wellbore;

increasing compressive stress in the formation as a result of the expanding step; and then injecting a fluid into the formation, thereby forming the inclusion in a direction of the increased compressive stress.

2. The method of claim 1, wherein the direction of the increased compressive stress is a radial direction relative to the wellbore.

3. The method of claim 1, further comprising the step of reducing stress in the formation in a tangential direction relative to the wellbore.

4. The method of claim 3, wherein the reducing stress step further comprises forming at least one perforation extending into the formation.

5. The method of claim 1, wherein the material in the expanding step comprises a hardenable material.

6. The method of claim 1, wherein the material in the expanding step includes a swellable material.

7. The method of claim 1, wherein the annulus in the expanding step is positioned between the wellbore and a sealing material surrounding the casing.

8. The method of claim 1, wherein the formation comprises weakly cemented sediment.

9. The method of claim 1, wherein the formation has a bulk modulus of less than approximately 750,000 psi.

10. The method of claim 1, wherein the fluid injecting step further comprises reducing a pore pressure in the formation at a tip of the inclusion.

11. The method of claim 1, wherein the fluid injecting step further comprises increasing a pore pressure gradient in the formation at a tip of the inclusion.

12. The method of claim 1, wherein the fluid injecting step further comprises fluidizing the formation at a tip of the inclusion.

13. The method of claim 1, wherein a viscosity of the fluid in the fluid injecting step is greater than approximately 100 centipoise.

14. The method of claim 1, wherein the formation has a cohesive strength of less than 400 pounds per square inch plus 0.4 times a mean effective stress in the formation at a depth of the inclusion.

15. The method of claim 1, wherein the formation has a Skempton B parameter greater than $0.95\exp(-0.04\,p')+0.008\,p'$, where p' is a mean effective stress at a depth of the inclusion.

16. The method of claim 1, wherein the fluid injecting step further comprises simultaneously forming multiple inclusions in the formation.

17. The method of claim 1, wherein the fluid injecting step further comprises forming four inclusions approximately aligned with orthogonal planes in the formation.

18. The method of claim 1, wherein the wellbore has been used for at least one of production from and injection into the formation for hydrocarbon production operations prior to the expanding step.

19. A method of forming at least one generally planar inclusion in a subterranean formation, the method comprising the steps of:

expanding a wellbore in the formation by injecting a material into an annulus positioned between the wellbore and a casing lining the wellbore;

reducing stress in the formation in a tangential direction relative to the wellbore; and then injecting a fluid into the formation, thereby forming the inclusion in a direction normal to the reduced tangential stress.

20. The method of claim 19, wherein the reducing stress step further comprises forming at least one perforation extending into the formation.

21. The method of claim 19, further comprising the step of increasing compressive stress in the formation as a result of the expanding step.

22. The method of claim 21, wherein a direction of the increased compressive stress is a radial direction relative to the wellbore.

23. The method of claim 19, wherein the material in the expanding step comprises a hardenable material.

24. The method of claim 19, wherein the material in the expanding step includes a swellable material.

25. The method of claim 19, wherein the annulus in the expanding step is positioned between the wellbore and a sealing material surrounding the casing.

26. The method of claim 19, wherein the formation comprises weakly cemented sediment.

27. The method of claim 19, wherein the formation has a drained bulk modulus of less than approximately 750,000 psi.

28. The method of claim 19, wherein the fluid injecting step further comprises reducing a pore pressure in the formation at a tip of the inclusion.

29. The method of claim 19, wherein the fluid injecting step further comprises increasing a pore pressure gradient in the formation at a tip of the inclusion.

30. The method of claim 19, wherein the fluid injecting step further comprises fluidizing the formation at a tip of the inclusion.

31. The method of claim 19, wherein a viscosity of the fluid in the fluid injecting step is greater than approximately 100 centipoise.

32. The method of claim 19, wherein the formation has a cohesive strength of less than 400 pounds per square inch plus 0.4 times a mean effective stress in the formation at a depth of the inclusion.

33. The method of claim 19, wherein the formation has a Skempton B parameter greater than $0.95\exp(-0.04\,p')+0.008\,p'$, where p' is a mean effective stress at a depth of the inclusion.

34. The method of claim 19, wherein the fluid injecting step further comprises simultaneously forming multiple inclusions in the formation.

35. A method of forming at least one generally planar inclusion in a subterranean formation, the method comprising the steps of:

installing a sleeve in a pre-existing casing lining a wellbore;

increasing compressive stress in the formation by injecting a material into an annulus positioned between the formation and the sleeve; and then injecting a fluid into the formation, thereby forming the inclusion in a direction of the increased compressive stress.

36. The method of claim 35, wherein the direction of the increased compressive stress is a radial direction relative to the wellbore.

37. The method of claim 35, further comprising the step of reducing stress in the formation in a tangential direction relative to the wellbore.

38. The method of claim 35, wherein the material comprises a hardenable material.

39. The method of claim 35, wherein the material includes a swellable material.

40. The method of claim 35, wherein the formation comprises weakly cemented sediment.

41. The method of claim 35, wherein the formation has a bulk modulus of less than approximately 750,000 psi.

42. The method of claim 35, wherein the fluid injecting step further comprises reducing a pore pressure in the formation at a tip of the inclusion.

43. The method of claim 35, wherein the fluid injecting step further comprises increasing a pore pressure gradient in the formation at a tip of the inclusion.

44. The method of claim 35, wherein the fluid injecting step further comprises fluidizing the formation at a tip of the inclusion.

45. The method of claim 35, wherein a viscosity of the fluid in the fluid injecting step is greater than approximately 100 centipoise.

46. The method of claim 35, wherein the formation has a cohesive strength of less than 400 pounds per square inch plus 0.4 times a mean effective stress in the formation at a depth of the inclusion.

47. The method of claim 35, wherein the formation has a Skempton B parameter greater than $0.95\exp(-0.04\,p')+0.008\,p'$, where p' is a mean effective stress at a depth of the inclusion.

48. The method of claim 35, wherein the fluid injecting step further comprises simultaneously forming multiple inclusions in the formation.

* * * * *